US006930653B2

(12) United States Patent
Rawnick et al.

(10) Patent No.: US 6,930,653 B2
(45) **Date of Patent: *Aug. 16, 2005**

(54) REFLECTOR AND SUB-REFLECTOR ADJUSTMENT USING FLUIDIC DIELECTRICS

(75) Inventors: James J. Rawnick, Palm Bay, FL (US); Stephen B. Brown, Palm Bay, FL (US)

(73) Assignee: Harris Corporation, Melbourne, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/438,436

(22) Filed: May 15, 2003

(65) Prior Publication Data

US 2004/0227691 A1 Nov. 18, 2004

(51) Int. Cl.[7] ..... H01Q 15/14; H01Q 19/14
(52) U.S. Cl. ..... 343/912; 343/781 R; 343/781 CA
(58) Field of Search ..... 343/912, 781 R, 343/781 P, 781 CA, 779, 757; H01Q 15/14, 19/14

(56) References Cited

U.S. PATENT DOCUMENTS

| | | | | |
|---|---|---|---|---|
| 5,162,972 | A | 11/1992 | Gripshover et al. | |
| 6,417,818 | B2 * | 7/2002 | Shipley et al. | 343/915 |
| 6,429,823 | B1 | 8/2002 | Bains et al. | |
| 6,456,254 | B1 * | 9/2002 | Reineix et al. | 343/840 |
| 6,515,235 | B2 | 2/2003 | Moller | |
| 6,650,304 | B2 * | 11/2003 | Lee et al. | 343/915 |

* cited by examiner

*Primary Examiner*—Hoanganh Le
(74) *Attorney, Agent, or Firm*—Sacco & Associates PA

(57) ABSTRACT

A reflector antenna (100) comprises a reflector unit (101) having a plurality of cavities (106), at least one fluidic dielectric having a permittivity and a permeability, and at least one composition processor (104) adapted for dynamically changing a composition of the fluidic dielectric to vary at least the permittivity or permeability in any of the plurality of cavities. The antenna further comprises a controller (102) for controlling the composition processor to selectively vary at least one among the permittivity and the permeability in at least one of the plurality of cavities in response to a control signal (105).

25 Claims, 3 Drawing Sheets

PRIOR ART

REFLECTOR AND SUB-REFLECTOR ADJUSTMENT USING FLUIDIC DIELECTRICS

BACKGROUND OF THE INVENTION

1. Statement of the Technical Field

The present invention relates to the field of antennas, and more particularly to adjustable reflectors and sub-reflectors using fluidic dielectrics.

2. Description of the Related Art

Typical satellite antenna systems use either parabolic reflectors or shaped reflectors to provide a specific beam coverage, or use a flat reflector system with an array of reflective printed patches or dipoles on the flat surface. These "reflect array" reflectors used in antennas are designed such that the reflective patches or dipoles shape the beam much like a shaped reflector or parabolic reflector would, but are much easier to manufacture and package on a spacecraft.

However, satellites typically are designed to provide a fixed satellite beam coverage for a given signal and may be limited in bandwidth by the structure of the reflectors. For example, Continental United States (CONUS) beams are designed to provide communications services to the entire continental United States. Once the satellite transmission system is designed and launched, changing the beam patterns to improve the operational bandwidth would be difficult.

The need to change the beam pattern provided by the satellite has become more desirable with the advent of direct broadcast satellites that provide communications services to specific areas and possibly on different frequencies ranges. Without the ability to change beam patterns and coverage areas as well as to flexibly use multiple frequency ranges, additional satellites must be launched to provide the services to possible future subscribers, which increases the cost of delivering the services to existing customers.

Some present systems are designed with minimal flexibility in the delivery of communications services. For example, a symmetrical Cassegrain antenna that uses a movable feed horn, defocuses the feed and zooms circular beams over a limited beam aspect ratio of 1:2.5. This scheme has high sidelobe gain and low beam-efficiency due to blockage by the feed horn and the subreflector of the Cassegrain system. Further, this type of system splits or bifurcates the main beam for beam aspect ratios greater than 2.5, resulting in low beam efficiency values. Other systems attempt to alter beam width and gain by using multiple feed horns. In any event, most of these systems will have a main reflected signal that will be interfered with by a sidelobe of the radiator or feed horn.

In another system as shown in FIG. 1, a dynamic reflector surface comprising an array of tunable reflective surfaces is used instead of a fixed reflector surface. Each element of the array can be tuned separately to change the phase during the process of reflection, and thus the beam pattern generated by the array of tunable reflectors can be changed in-flight in a simple manner. Each reflecting element in the array is a horn reflecting device which reflects an electric field emanating from a single feed horn. Each horn in the array has the capability of changing the phase during the process of incidence and reflection. This phase shift can then be used to change the shape of the beam emanating from the array. The phase shift can be incorporated by either using a movable short or by using a variable phase-shifter inside the horn and a short. By using "phase-shifting" which can be controlled on-orbit, a relatively simple reconfigurable antenna can be designed. This approach is much simpler than an active array in terms of cost and complexity.

More specifically, FIG. 1 illustrates a front, side, and isometric view of the existing horn reflect array as described in U.S. Pat. No. 6,429,823. Reflect array 200 is illuminated with RF energy from feed horn 202. Reflect array 200 comprises a plurality of reflective elements 204 that are configured in a reflector array 206. Side view 208 shows that feed horn 202 is pointed at the open end 210 of reflective element 204. Side view 208 also shows that reflector array 206 can be a curved array. Further, front view 212 and isometric view 214 show that reflective elements 204 can be placed in a circular arrangement for reflector array 206. Each reflective element 204 reflects a portion of the incident RF energy, and by changing the respective phase for each reflective element 204, the respective phase of the portion of the reflected RF energy for each respective reflective element 204 can be changed. By changing the phase of each portion of the reflected RF energy, different beam patterns can be generated by the horn reflect array. Although the reflector array 206 provides lower non-recurring costs for a satellite and can generate a plurality of different shaped beam patterns without reconfiguring the physical hardware, e.g., without moving the location of the feed horn 202 and the reflective elements 204 in the reflector array 206, the design is still too complicated to achieve substantially similar results. Fortunately, the only thing that must change from mission to mission using the reflect array 200 is the programming of the reflective elements 204.

In any event, a programmable array such as the reflector array 206 can be reconfigured on-orbit. Satellites using the reflector array 206 can be designed for use in clear sky conditions, and, when necessary, the beams emanating from the reflector array 206 can be shaped to provide higher gains over geographic regions having rain or other poor transmission conditions, thus providing higher margins during clear sky conditions.

It can be seen, then, that there is a need in the art for an antenna system that can be alternatively reconfigured in-flight without the need for complex systems. It can also be seen that there is a need in the art for a communications system that can be reconfigured in-flight that has high beam-efficiencies and high beam aspect ratios. An alternative arrangement for achieving the advantages of the antenna of FIG. 1 and other advantages as will be further described below utilizes fluidic dielectrics in accordance with the present invention.

Two important characteristics of dielectric materials are permittivity (sometimes called the relative permittivity or $\epsilon_r$) and permeability (sometimes referred to as relative permeability or $\mu_r$) The relative permittivity and permeability determine the propagation velocity of a signal, which is approximately inversely proportional to $\sqrt{\mu\epsilon}$. The propagation velocity directly effects the electrical length of a transmission line and therefore the amount of delay introduced to signals that traverse the line.

Further, ignoring loss, the characteristic impedance of a transmission line, such as stripline or microstrip, is equal to $\sqrt{L_l/C_l}$ where $L_l$ is the inductance per unit length and $C_l$ is the capacitance per unit length. The values of $L_l$ and $C_l$ are generally determined by the permittivity and the permeability of the dielectric material(s) used to separate the transmission line structures as well as the physical geometry and spacing of the line structures.

For a given geometry, an increase in dielectric permittivity or permeability necessary for providing increased time delay will generally cause the characteristic impedance of the line to change. However, this is not a problem where only a fixed delay is needed, since the geometry of the transmission line can be readily designed and fabricated to achieve the proper characteristic impedance. Analogously, wave propagation delays and energy beam patterns through dielectric materials in reflector and/or sub-reflector based antenna systems are typically designed accordingly with a fixed dielectric permittivity or permeability. When various time delays are needed for specific energy shaping or beam forming requirements, however, such techniques have traditionally been viewed as impractical because of the obvious difficulties in dynamically varying the permittivity and/or permeability of a dielectric board substrate material. Accordingly, the only practical solution has been to design variable delay lines using conventional fixed length RF transmission lines with delay variability achieved using a series of electronically controlled switches. Such schemes would be impracticable and overly complicated for a reflector or sub-reflector based antenna.

SUMMARY OF THE INVENTION

The invention concerns an antenna utilizing a reflector and/or sub-reflector which includes at least one cavity and the presence, absence or mixture of fluidic dielectric in the cavity. A pump or a composition processor, for example, can be used to add, remove, or mix the fluidic dielectric to the cavity in response to a control signal. A propagation delay or beam pattern or gain of a radiated signal through the antenna is selectively varied by manipulating the fluidic dielectric within the cavity.

The fluidic dielectric can be comprised of an industrial solvent. If higher permeability is desired, the industrial solvent can have a suspension of magnetic particles contained therein. The magnetic particles can be formed of a wide variety of materials including those selected from the group consisting of ferrite, metallic salts, and organo-metallic particles.

In accordance with a first embodiment of the present invention, a reflector antenna comprises a reflector unit having a plurality of cavities, at least one fluidic dielectric having a permittivity and a permeability, and at least one composition processor adapted for dynamically changing a composition of the fluidic dielectric to vary at least the permittivity or permeability in any of the plurality of cavities. The antenna further comprises a controller for controlling the composition processor to selectively vary at least one among the permittivity and the permeability in at least one of the plurality of cavities in response to a control signal.

In accordance with a second embodiment of the present invention, a reflector antenna comprises a reflector unit having a plurality cavities, at least one fluidic dielectric having a permittivity and a permeability, and at least one fluidic pump unit for moving at least one fluidic dielectric among at least one of the plurality of cavities and a reservoir for adding and removing the fluid dielectric to at least one of the plurality of cavities in response to a control signal.

In yet another embodiment of the present invention, a method for energy shaping a radio frequency (RF) signal comprises the steps of propagating the RF signal through a reflector antenna and dynamically adding and removing a fluidic dielectric to at least one cavity within the reflector antenna to vary a propagation delay of the RF signal.

DETAILED DESCRIPTION OF THE INVENTION

Figure 1:
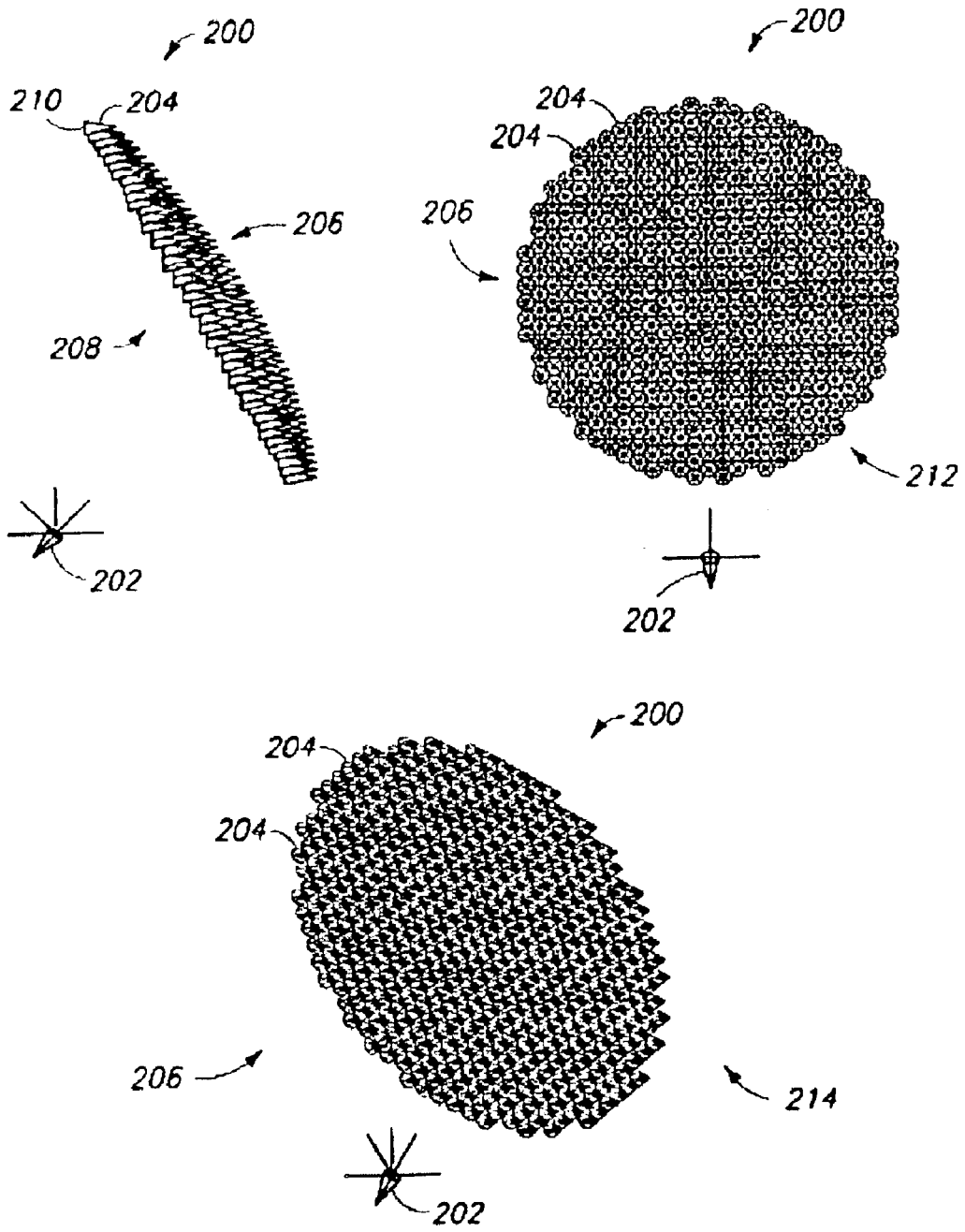
FIG. 1 illustrates a front, side, and isometric view of a horn reflect array of an existing antenna system.

Although the antenna of FIG. 1 provides more flexibility than a conventional satellite reflector antenna, it is the ability to vary the dielectric value of a reflective element in the antenna of the present invention that enables it to be used in more than just a particular application or operating range. Reflectors and sub-reflectors in prior antennas all have static or fixed dielectric values. In contrast, the present invention utilize a fluidic cavity as shall hereinafter be described in greater detail to provide even greater design flexibility for antenna capable of further applications and wider operating ranges.

Figure 2:
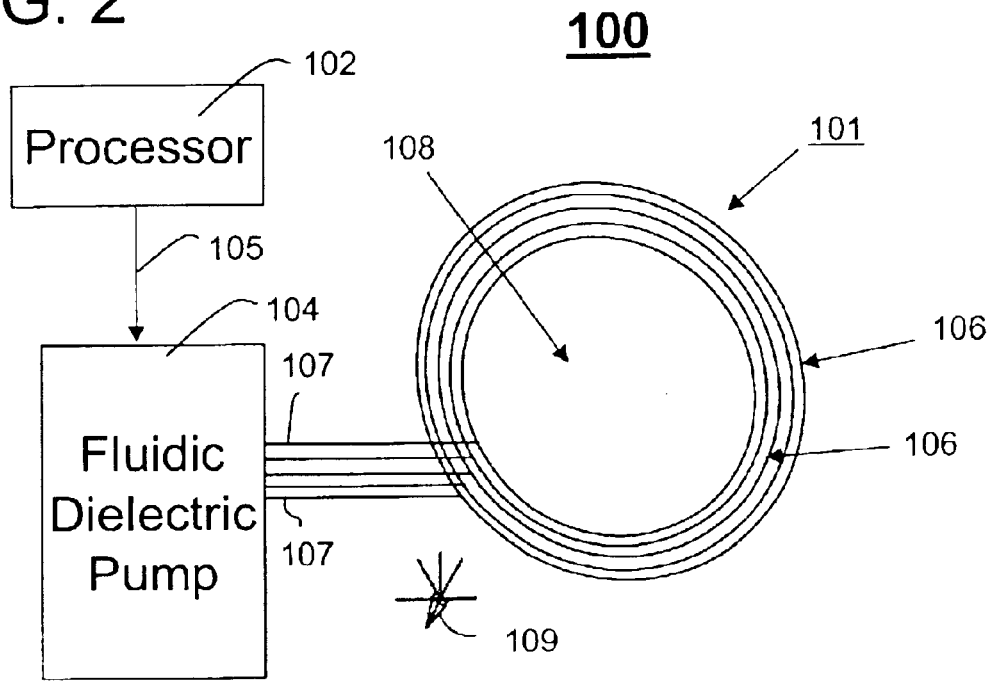
FIG. 2 is a schematic diagram of an adjustable reflector antenna system in accordance with the present invention.
Figure 3:
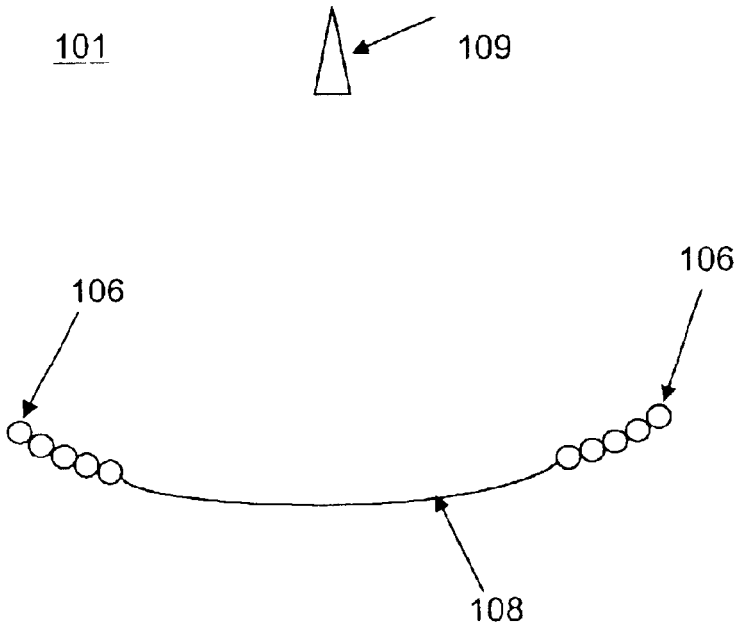
FIG. 3 is a side view of the adjustable reflector antenna system of FIG. 2.

Referring to FIGS. 2 and 3, a schematic diagram of an antenna system 100 using a reflector unit 101 having a plurality of cavities 106 that can contain at least one fluidic dielectric having a permittivity and a permeability is shown. The cavities 106 can be a plurality of concentric tubes such as quartz capillary tubes on the outer periphery of the reflector unit 101, although the invention is not limited to such arrangement in terms of cavities and construction. The antenna 100 can further include at least one composition processor or pump 104 adapted for dynamically changing a composition of the fluidic dielectric to vary at least the permittivity and/or permeability in any of the plurality of cavities 106. It should be understood that the at least one composition processor can be independently operable for adding and removing the fluidic dielectric from each of said plurality of cavities. The fluidic dielectric can be moved in and out of the respective cavities using feed lines 107 for example. The antenna 100 can further include a controller or processor 102 for controlling the composition processor 104 to selectively vary at least one of the permittivity and/or the permeability in at least one of the plurality of cavities in response to a control signal. Preferably, the reflector unit 101 comprises a main solid dielectric reflector portion 108 surrounded on the periphery by the cavities 106 in the form of a plurality of concentric tubes. The reflector portion 108 and cavities 106 are preferably spaced apart from a feed horn or radiator 109. The concentric tubes can ideally be quartz capillary tubes, although the invention is not limited thereto. Alternatively, the reflector unit 101 can be completely formed by a concentric series of cavities 106 without using a solid dielectric reflector portion 108 in a center area. As previously described, the fluidic dielectric used in the cavities can be comprised of an industrial solvent having a suspension of magnetic particles. Note that either a conductive or a dielectric fluid could be used. If a conductive or very high dielectric fluid were used, then the fluidic region would appear reflective to RF energy. If a low to moderate dielectric fluid were used then the fluid would be either slightly reflective and/or lossy and would have a tapering effect. The magnetic particles are preferably formed of a material selected from the group consisting of ferrite, metallic salts, and organo-metallic particles although the invention is not limited to such compositions.

Referring again to FIG. 2, the controller or processor 102 is preferably provided for controlling operation of the antenna 100 in response to a control signal 105. The controller 102 can be in the form of a microprocessor with associated memory, a general purpose computer, or could be implemented as a simple look-up table.

For the purpose of introducing time delay or energy shaping in accordance with the present invention, the exact size, location and geometry of the cavity structure as well as the permittivity and permeability characteristics of the fluidic dielectric can play an important role. The processor and pump or flow control device (102 and 104) can be any suitable arrangement of valves and/or pumps as may be necessary to independently adjust the relative amount of fluidic dielectric contained in the cavities 106. Even a MEMS type pump device (not shown) can be interposed between the cavity and a reservoir for this purpose. However, those skilled in the art will readily appreciate that the invention is not so limited as MEMS type valves and/or larger scale pump and valve devices can also be used as would be recognized by those skilled in the art.

Figure 4:
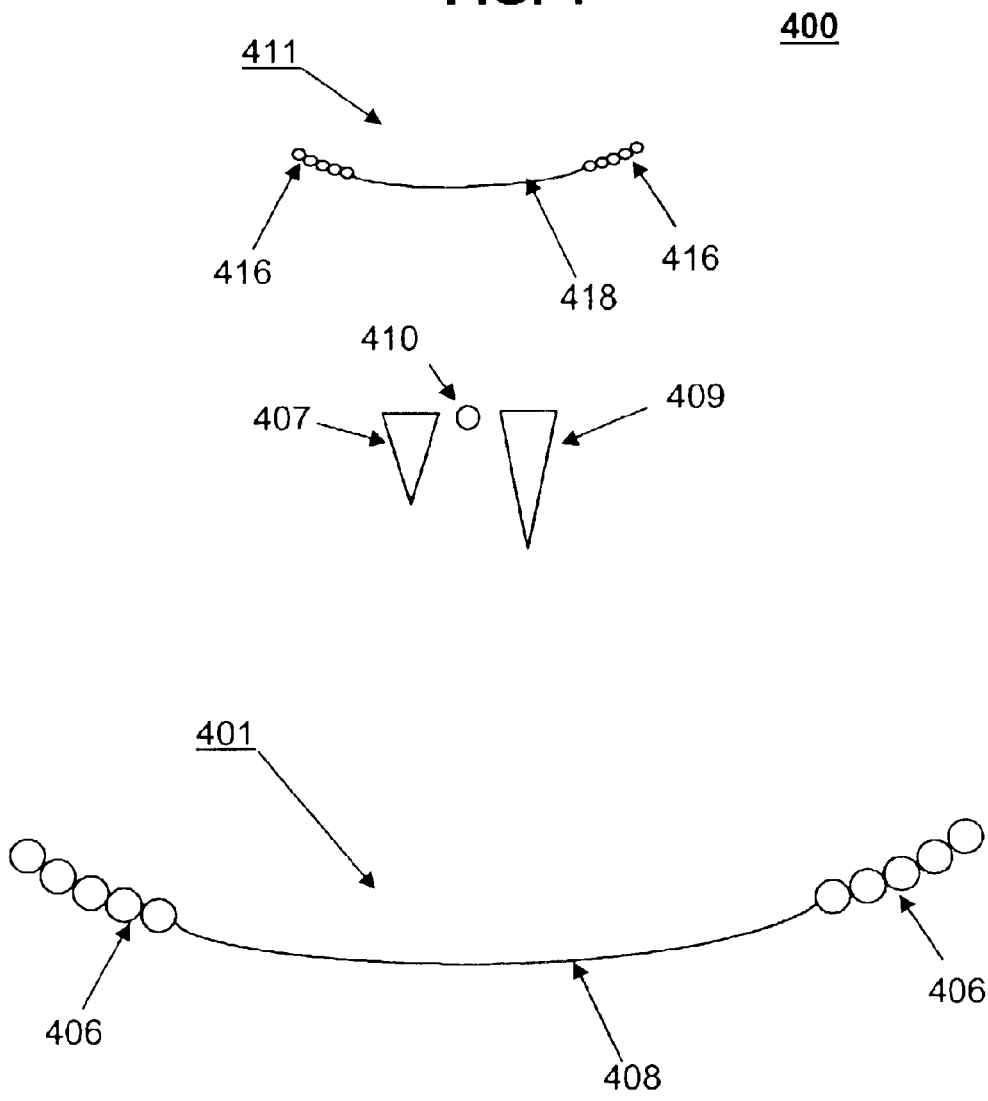
FIG. 4 is a side view of an adjustable reflector and sub-reflector antenna system in accordance with the present invention.

The flow control device can ideally cause the fluidic dielectric to completely or partially fill any or all of the cavities 106 (or cavities 406 and/or 416 in FIG. 4). The flow control device can also cause the fluidic dielectric to be evacuated from the cavity into a reservoir (not shown). According to a preferred embodiment, each flow control device is preferably independently operable by controller 102 so that fluidic dielectric can be added or removed from selected ones of the cavities 106 to produce the required amount of delay indicated by a control signal 105.

Propagation delay of signals in the dielectric lens antenna can be controlled by selectively controlling the presence and removal or mixture of fluidic dielectric from the cavities 106. Since the propagation velocity of a signal is approximately inversely proportional to $\sqrt{\mu\epsilon}$, the different permittivity and/or permeability of the fluidic dielectric as compared to an empty cavity (or a cavity having a different mixture with different dielectric properties) will cause the propagation velocity (and therefore the amount of delay introduced)) to be different.

According to yet another embodiment of the invention, different ones of the cavities 106 can have different types of fluidic dielectric contained therein so as to produce different amounts of delay for RF signals traversing the antenna 100. For example, larger amounts of delay can be introduced by using fluidic dielectrics with proportionately higher values of permittivity and permeability. Using this technique, coarse and fine adjustments can be effected in the total amount of delay introduced or in the desired energy shaping of the radiated signal.

As previously noted, the invention is not limited to any particular type of structure. The cavities do not necessarily need to be tubes or in concentric arrangements as shown, but can be formed in various arrangements to accomplish the objectives of the present invention.

Composition of the Fluidic Dielectric

The fluidic dielectric can be comprised of any fluid composition having the required characteristics of permittivity and permeability as may be necessary for achieving a selected range of delay. Those skilled in the art will recognize that one or more component parts can be mixed together to produce a desired permeability and permittivity required for a particular time delay or radiated energy shape. In this regard, it will be readily appreciated that fluid miscibility can be a key consideration to ensure proper mixing of the component parts of the fluidic dielectric.

The fluidic dielectric also preferably has a relatively low loss tangent to minimize the amount of RF energy lost in the antenna. Aside from the foregoing constraints, there are relatively few limits on the range of materials that can be used to form the fluidic dielectric. Accordingly, those skilled in the art will recognize that the examples of suitable fluidic dielectrics as shall be disclosed herein are merely by way of example and are not intended to limit in any way the scope of the invention. Also, while component materials can be mixed in order to produce the fluidic dielectric as described herein, it should be noted that the invention is not so limited. Instead, the composition of the fluidic dielectric could be formed in other ways. All such techniques will be understood to be included within the scope of the invention.

Those skilled in the art will recognize that a nominal value of permittivity ($\epsilon_r$) for fluids is approximately 2.0. However, the fluidic dielectric used herein can include fluids with higher values of permittivity. For example, the fluidic dielectric material could be selected to have a permittivity values of between 2.0 and about 58, depending upon the amount of delay or energy shape required.

Similarly, the fluidic dielectric can have a wide range of permeability values. High levels of magnetic permeability are commonly observed in magnetic metals such as Fe and Co. For example, solid alloys of these materials can exhibit levels of $\mu_r$ in excess of one thousand. By comparison, the permeability of fluids is nominally about 1.0 and they generally do not exhibit high levels of permeability. However, high permeability can be achieved in a fluid by introducing metal particles/elements to the fluid. For example typical magnetic fluids comprise suspensions of ferro-magnetic particles in a conventional industrial solvent such as water, toluene, mineral oil, silicone, and so on. Other types of magnetic particles include metallic salts, organometallic compounds, and other derivatives, although Fe and Co particles are most common. The size of the magnetic particles found in such systems is known to vary to some extent. However, particles sizes in the range of 1 nm to 20 $\mu$m are common. The composition of particles can be selected as necessary to achieve the required permeability in the final fluidic dielectric. Magnetic fluid compositions are typically between about 50% to 90% particles by weight. Increasing the number of particles will generally increase the permeability.

Example of materials that could be used to produce fluidic dielectric materials as described herein would include oil (low permittivity, low permeability), a solvent (high permittivity, low permeability) and a magnetic fluid, such as combination of a solvent and a ferrite (high permittivity and high permeability). A hydrocarbon dielectric oil such as Vacuum Pump Oil MSDS-12602 could be used to realize a low permittivity, low permeability fluid, low electrical loss fluid. A low permittivity, high permeability fluid may be realized by mixing same hydrocarbon fluid with magnetic particles such as magnetite manufactured by FerroTec Corporation of Nashua, N.H., or iron-nickel metal powders manufactured by Lord Corporation of Cary, N.C. for use in ferrofluids and magnetoresrictive (MR) fluids. Additional ingredients such as surfactants may be included to promote uniform dispersion of the particle. Fluids containing electrically conductive magnetic particles require a mix ratio low enough to ensure that no electrical path can be created in the mixture. Solvents such as formamide inherently posses a relatively high permittivity. Similar techniques could be used to produce fluidic dielectrics with higher permittivity. For example, fluid permittivity could be increased by adding high permittivity powders such as barium titanate manufactured by Ferro Corporation of Cleveland, Ohio. For broadband applications, the fluids would not have significant resonances over the frequency band of interest.

The antennas of FIGS. 2–4 also reveal a method for energy shaping an RF signal comprising the steps of propagating the RF signal through a reflector or sub-reflector antenna and dynamically adding and removing a fluidic dielectric to at least one cavity within the reflector or sub-reflector to vary a propagation delay or energy shape of the RF signal. The method could also include the step of selectively adding and removing a fluidic dielectric from selected ones of a plurality of said cavities of the antenna in response to a control signal. The method could also include the step of selecting a permeability and a permittivity for said fluidic dielectric for maintaining a constant characteristic impedance along an entire length of at least one cavity. It should also be noted that the step of dynamically adding and removing a fluidic dielectric can comprise the step of mixing fluidic dielectric to obtain a desired permeability and permittivity. According to a preferred embodiment, each cavity can be either made full or empty of fluidic dielectric in order to implement the required time delay or energy shape. However, the invention is not so limited and it is also possible to only partially fill or partially drain the fluidic dielectric from one or more of the cavities.

In either case, once the controller has determined the updated configuration for each of the cavities necessary to implement the time delay, the controller can operate device 104 to implement the required delay. The required configuration can be determined by one of several means. One method would be to calculate the total time delay for each cavity or for all the cavities at once. Given the permittivity and permeability of the fluid dielectrics in the cavities, and any surrounding solid dielectric (108 in FIG. 3 or 408 in FIG. 4 for example), the propagation velocity could be calculated for the reflector unit. These values could be calculated each time a new delay time request is received or particular energy is required or could be stored in a memory associated with controller or processor 102.

As an alternative to calculating the required configuration for a given delay or energy shape, the controller 102 could also make use of a look-up-table (LUT). The LUT can contain cross-reference information for determining control data for fluidic delay units necessary to achieve various different delay times and energy shapes. For example, a calibration process could be used to identify the specific digital control signal values communicated from controller 102 to the cavities that are necessary to achieve a specific delay value or energy shape. These digital control signal values could then be stored in the LUT. Thereafter, when control signal 105 is updated to a new requested delay time, the controller 102 can immediately obtain the corresponding digital control signal for producing the required delay.

As an alternative, or in addition to the foregoing methods, the controller 102 could make use of an empirical approach that injects a signal at an RF input port and measures the delay to an RF output port. Specifically, the controller 102 could check to see whether the appropriate time delay or energy shape had been achieved. A feedback loop could then be employed to control the flow control devices (104) to produce the desired delay characteristic.

Referring to FIG. 4, a schematic diagram of an antenna system 400 using a reflector unit 401 and a sub-reflector unit 411 is shown. The reflector unit has a plurality of cavities 406 that can contain at least one fluidic dielectric. Likewise, the sub-reflector unit has a plurality of cavities 416 that can also contain at least one fluidic dielectric. The cavities 406 and 416 can be a plurality of concentric tubes such as quartz capillary tubes on the outer periphery of the respective reflector unit 401 or sub-reflector unit 411, although the invention is not limited to such arrangement in terms of cavities and construction. The antenna 400 can further include at least one composition processor or pump, controller, & respective feed lines (not shown) all as similarly discussed with respect to FIG. 2 which is similarly adapted for dynamically changing a composition of the fluidic dielectric to vary at least the permittivity and/or permeability in any of the plurality of cavities 406 or 416. Preferably, the reflector unit 401 comprises a main solid dielectric reflector portion 408 surrounded on the periphery by the cavities 406 in the form of a plurality of concentric tubes. The sub-reflector unit 411 preferably comprises a main solid dielectric reflector portion 418 surrounded on the periphery by the cavities 416 in the form of a plurality of concentric tubes. Preferably, at least one feed horn 409 or additional feed horns (407) are spaced between the reflector unit 401 and the sub-reflector unit 411 as shown. The concentric tubes can ideally be quartz capillary tubes, although the invention is not limited thereto. Alternatively, the reflector unit 401 and or sub-reflector unit 411 can be completely formed by a concentric series of cavities 406 or 416 respectively without using a solid dielectric member (408 or 418) in a center area. If one feed horn is used, it is preferably placed at a focal point 410. If more than one feed horn is used as shown, the feed horns are preferably spaced equidistant from the focal point.

The present invention is ideally applicable to any reflector or sub-reflector type antenna. Operationally, the present invention enables a system designer to alter the size of the reflective surface for a given application or frequency range. The present invention adds further flexibility by controlling the reflection off the surface of the reflectors by dynamically changing the size of the surface with the fluidic dielectric. In essence, the reflector size can be made to vary based on the frequency or application as opposed to existing systems that are constructed on the basis of fixed frequencies since feeds are frequency dependent generally. In this manner, sidelobes created by different feed horns can each be independently averted and not reflected as required by manipulating the size of the reflectors or sub-reflectors using the fluidic dielectric. In one embodiment, when the fluidic dielectric is present, the reflector or sub-reflector is effectively extended in size and when the fluidic dielectric is removed the reflector or sub-reflector is effectively reduced in size.

Those skilled in the art will recognize that a wide variety of alternatives could be used to adjust the presence or absence or mixture of the fluid dielectric contained in each of the cavities. Additionally, those skilled in the art should also recognize that a wide variety of configurations in terms of cavities and reflectors or sub-reflectors could also be used with the present invention. The reflector or sub-reflector of the present invention can be assembled in a configuration that resembles a reflector in forms such as parabolic, circular, flat, etc, depending on the desires of the designer for the available or desired beam patterns antenna. Accordingly, the specific implementations described herein are intended to be merely examples and should not be construed as limiting the invention.

We claim:

1. A reflector antenna, comprising:

a reflector unit having a plurality of cavities;

at least one fluidic dielectric having a permittivity and a permeability;

at least one composition processor adapted for dynamically changing a composition of said fluidic dielectric to vary at least one of said permittivity and said permeability in any of the plurality of cavities; and a controller for controlling said composition processor to selectively vary at least one of said permittivity and said permeability in at least one of said plurality of cavities in response to a control signal.

2. The reflector antenna of claim 1, wherein the reflector unit comprises a reflector portion surrounded on its periphery by the plurality of cavities.

3. The reflector antenna of claim 2, wherein the plurality of cavities comprises a plurality of concentric tubes.

4. The reflector antenna of claim 3, wherein the plurality of concentric tubes comprises quartz capillary tubes.

5. The reflector antenna of claim 1, wherein the reflector unit is all comprised of the plurality of cavities.

6. The reflector antenna of claim 2, wherein the reflector portion is a solid dielectric substrate.

7. The reflector antenna of claim 1, wherein each of said at least one composition processor is independently operable for adding and removing said fluidic dielectric from each of said plurality of cavities.

8. The reflector antenna according to claim 1, wherein said fluidic dielectric is comprised of an industrial solvent.

9. The reflector antenna according to claim 8, wherein said fluidic dielectric is comprised of an industrial solvent that has a suspension of magnetic particles contained therein.

10. The reflector antenna according to claim 9, wherein said magnetic particles are formed of a material selected from the group consisting of ferrite, metallic salts, and organo-metallic particles.

11. The reflector antenna according to claim 1, wherein the reflector antenna further comprises at least one feed horn spaced between the reflector unit and a sub-reflector unit.

12. The reflector antenna according to claim 11, wherein the sub-reflector further comprises a plurality of cavities capable of having at least one fluidic dielectric therein.

13. A reflector antenna, comprising:

a reflector unit having a plurality cavities;

at least one fluidic dielectric having a permittivity and a permeability;

at least one fluidic pump unit for moving said at least one fluidic dielectric among at least one of said plurality of cavities and a reservoir for adding and removing said fluid dielectric to said at least one of said plurality of cavities in response to a control signal.

14. The reflector antenna of claim 13, wherein the reflector unit comprises a reflector portion surrounded on its periphery by the plurality of cavities.

15. The reflector antenna of claim 14, wherein the plurality of cavities comprises a plurality of concentric tubes.

16. The reflector antenna of claim 15, wherein the plurality of concentric tubes comprises quartz capillary tubes.

17. The reflector antenna of claim 13, wherein the reflector unit is all comprised of the plurality of cavities.

18. The reflector antenna of claim 14, wherein the reflector portion is a solid dielectric substrate.

19. The reflector antenna according to claim 1, wherein said fluidic dielectric is comprised of an industrial solvent having a suspension of magnetic particles contained therein, wherein said magnetic particles are formed of a material selected from the group consisting of ferrite, metallic salts, and organo-metallic particles.

20. The reflector antenna according to claim 1, wherein the reflector antenna further comprises at least one feed horn spaced between the reflector unit and a sub-reflector unit.

21. The reflector antenna according to claim 11, wherein the sub-reflector further comprises a plurality of cavities capable of having at least one fluidic dielectric therein.

22. A method for energy shaping a radio frequency signal, comprising the steps of:

propagating the radio frequency signal through a reflector antenna;

dynamically adding and removing a fluidic dielectric to at least one cavity within the reflector antenna to vary a propagation delay of said radio frequency signal.

23. The method according to claim 22, further comprising the step of selectively adding and removing a fluidic dielectric from selected ones of a plurality of said cavities of the reflector antenna in response to a control signal.

24. The method according to claim 22, further comprising the step of selecting a permeability and a permittivity for said fluidic dielectric for maintaining a constant characteristic impedance along an entire length of said at least one cavity.

25. The method according to claim 22, wherein the step of dynamically adding and removing a fluidic dielectric comprises the step of mixing fluidic dielectric to obtain a desired permeability and permittivity.

* * * * *